United States Patent [19]

Kaufman et al.

[11] 4,404,001

[45] Sep. 13, 1983

[54] DETERGENT AND CORROSION INHIBITOR AND MOTOR FUEL COMPOSITION CONTAINING SAME

[75] Inventors: Benjamin J. Kaufman, Wappingers Falls; Sheldon Herbstman, Spring Valley; Mark Levin, Fishkill, all of N.Y.

[73] Assignee: Texaco Inc., White Plains, N.Y.

[21] Appl. No.: 414,270

[22] Filed: Sep. 2, 1982

[51] Int. Cl.[3] ..... C10L 1/22

[52] U.S. Cl. ..... 44/63; 44/71; 252/392

[58] Field of Search ..... 44/63, 71; 252/392

[56] References Cited

U.S. PATENT DOCUMENTS

| | | | |
|---|---|---|---|
| 4,177,041 | 12/1979 | Sung et al. | 44/71 |
| 4,253,876 | 3/1981 | Godar et al. | 252/392 |
| 4,290,778 | 9/1981 | Herbstman | 44/71 |
| 4,364,846 | 12/1982 | Kaufman | 44/71 |

*Primary Examiner*—Charles F. Warren
*Assistant Examiner*—Y. Harris-Smith
*Attorney, Agent, or Firm*—Robert A. Kulason; Robert Knox, Jr.; James J. O'Loughlin

[57] ABSTRACT

As a detergent and corrosion inhibiting fuel additive, the product resulting from reaction of trimellitic anhydride and a N- $C_{10}$–$C_{25}$-hydrocarbyl-1,3-diaminopropane and a fuel composition containing same.

10 Claims, No Drawings

DETERGENT AND CORROSION INHIBITOR AND MOTOR FUEL COMPOSITION CONTAINING SAME

BACKGROUND OF THE INVENTION

1. Field of the Invention

Gasoline compositions are highly refined products. Despite this, they contain minor amounts of impurities which can promote corrosion during the period that the fuel is transported in bulk or held in storage. Corrosion can also occur in the fuel tank, fuel lines and carburetor of a motor vehicle. As a result, a commercial motor fuel composition must contain a corrosion inhibitor to inhibit or prevent corrosion.

Internal combustion engine design is undergoing changes to meet new standards for engine exhaust gas emissions. One design change involves the feeding of blow-by gases from the crankcase zone of the engine into the intake air supply to the carburetor rather than venting these gases to the atmosphere as in the past. Another change involves recycling part of the exhaust gases to the combustion zone of the engine in order to minimize objectionable emissions. Both the blow-by gases from the crankcase zone and the recycled exhaust gases contains significant amounts of deposit-forming substances which promote the formation of deposits in and around the throttle plate area of the carburetor. These deposits restrict the flow of air through the carburetor at low speeds so that an overrich fuel mixture results. This condition produces rough engine idling or stalling causing an increase in the amount of polluting exhaust gas emissions, which the engine design changes were intended to overcome, and decreasing fuel efficiency.

An acceptable motor fuel requires additives designed to correct or inhibit the noted disabling characteristics of motor fuels. Thus, the discovery of a novel and cost effective motor fuel additive capable of general application which combines good detergency properties with effective corrosion inhibition will provide a material advance in the state of the art.

2. Description of the Prior Art

U.S. Pat. No. 4,225,319 issued Sept. 30, 1980 discloses a method for suppressing carburetor deposit formation of motor fuels by the addition of aromatic amines.

U.S. Pat. No. 1,665,621 issued Apr. 10, 1928 discloses a liquid fuel containing an oxide of nitrogen.

SUMMARY OF THE INVENTION

It is the subject of this invention to provide a detergent and corrosion inhibiting fuel additive and motor fuel composition containing same.

It has now been discovered that a novel product resulting from the reaction of 1 mole of trimellitic anhydride having the following formula:

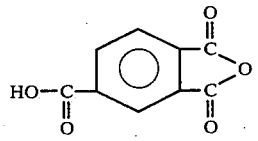

with from about 1.5 to about 2.5 moles of a N-$C_{10}$ to $C_{25}$ hydrocarbyl 1,3 diaminopropane is possessed of efficacious detergent and corrosion inhibiting properties when incorporated in a motor fuel composition for an internal combustion engine.

The novel fuel composition of the invention prevents or reduces corrosion during the transportation, storage and the final use of the fuel. The fuel of the invention also is especially effective in its carburetor detergency properties, particularly in its ability to prevent deposit buildup on a clean carburetor.

DESCRIPTION OF THE PREFERRED EMBODIMENTS

The reaction product additive of the present invention is prepared by reacting 1 mole of trimellitic anhydride having the following formula:

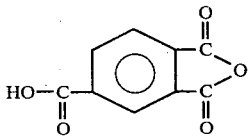

with from about 1.5 to about 2.5 moles of $C_{10}$–$C_{25}$ hydrocarbyl 1,3-diamino propane at about 170° C. for approximately 1 hour to form the detergent and corrosion inhibiting fuel additive of the invention.

In general a mixture of trimellitic acid 1,2 anhydride, N-$C_{10}$–$C_{25}$-hydrocarbyl-1,3-diaminopropane and solvent is heated at reflux from about 60° to 180° C. for a sufficient length of time to effect the reaction while removing the water formed. Usually, the reaction mixture is heated from about 140° to about 180° C., and preferably from 170° to 175° C. for a period of about 1 hour, leaving the diamide of trimellitic anhydride as a 50 wt. % solution in the solvent.

The mole ratio of N-$C_{10}$–$C_{25}$-alkyl-1,3-diaminopropane to trimellitic anhydride ranges from about 1.5:1 to about 2.5:1 with the preferred ratio being 2:1.

Examples of $C_{10}$–$C_{25}$-alkyl-1,3-diaminopropanes which may be employed in preparing the additive of the invention are: N-octadecenyl-1,3-diaminopropane; N-dodecenyl-1,3-diaminopropane; N-lauryl-1,3-diaminopropane; N-stearyl-1,3-diaminopropane; and N-tallow-1,3-diamino propane.

EXAMPLE I

A mixture of 96 grams of trimellitic acid-1,2-anhydride, 350 grams of N-octadecenyl-1,3-diaminopropane (DUOMEEN OL) and 450 grams of xylene was heated at reflux for 2 hours while removing water. 19.8 milliliters of water were removed. The xylene solvent was also removed yielding 431 grams of crude reaction product. The crude product was analyzed and the following results were obtained.

| | |
|---|---|
| N, wt % | 2.83 |
| TAN | 19.47 |
| TBN | 62.7 |
| SAP. No. | 22.3 |
| Viscosity, cSt @ 40° C. | 284.2 |
| Viscosity, cSt @ 100° C. | 26.31 |
| Specific Gravity, 60° F./60° F. | 0.9345 |

The material was then blended up to 50 wt.% in mineral oil with viscosity of 100 SUS (100° F.).

EXAMPLE II

A mixture of 96 g of trimellitic acid-1,2-anhydride, 362 g of N-octadecenyl-1,3-diaminopropane and 458 g of a mineral oil with viscosity of 100 SUS (100° F.) was heated to 170° for 45 minutes. The product was analyzed and the following results were obtained.

| | |
|---|---|
| N, wt % | 3.20 |
| TAN | 20.4 |
| TBN | 68.5 |
| SAP No. | 21.94 |

EXAMPLE III

A mixture of 96 grams of trimellitic acid-1,2-anhydride, 350 grams of N-dodecenyl 1,3 diaminopropane and 450 grams of xylene are heated at reflux for about 2 hours. Water and xylene are also removed to give a substantial yield of a crude reaction product.

In general, the additive is added to the motor fuel composition of the invention in an amount effective to provide carburetor detergency and corrosion inhibition to the fuel composition. The additive is highly effective in an amount ranging from about 0.0004 to 0.04 weight percent based on the total fuel composition. An amount ranging from about 0.0004 to 0.008 weight percent is preferred with the most preferred concentration ranging from about 0.002 to 0.004 weight percent.

The additive of the invention is particularly efficacious in that the provision of detergency and corrosion inhibition to the fuel composition does not cause the formation of an emulsion which would make it unacceptable for commercial purposes.

The base fuel may consist of straight-chain or branched-chain paraffins, cycloparaffins, olefins, aromatic hydrocarbons, and any mixture of these. The base fuel can be derived from straight-run naphtha, polymer gasoline, natural gasoline or from catalytically reformed stocks, boiling in the range from about 80° to 450° F. and representative of a typical hydrocarbon fuel composition for a spark ignited internal combustion engine. The composition and the octane level of the base fuel are not critical and any conventional motor fuel base can be employed in the practice of this invention.

The preferred base fuel in which the additive of the invention is employed is a mixture of hydrocarbons boiling in the gasoline boiling range.

The fuel composition of the invention may contain any of the additives normally employed in a motor fuel. For example, the base fuel may be blended with an anti-knock compound, such as a tetramethyl lead, tetrabutyl lead, cyclopentadienyl manganese tricarbonyl, and chemical and physical mixture thereof, generally in a concentration from about 0.05 to 4.0 cc. per gallon of fuel. The tetraethyl lead mixture commercially available for automotive use contains an ethylene chloride-ethylene bromide mixture as a scavenger for removing lead from the combustion chamber in the form of a volatile lead halide. The motor fuel composition may also be fortified with any of the conventional anti-icing additives, dyes and the like.

Gasoline blends were prepared from typical base fuels mixed with specified amounts of the prescribed fuel additive of the invention. This fuel were then tested to determine the effectiveness of the additive fuel. The results obtained in these tests using a commercial detergent gasoline are also given.

The Base Fuel used in the Chevrolet Carburetor Detergency Test, the Buick Carburetor Detergency Test and the NACE Corrosion Test is an unleaded grade gasoline having a Research Octane Number of about 93. This gasoline consists of about 32 weight percent aromatic hydrocarbons, 8 weight percent olefinic hydrocarbons and 60 weight percent paraffinic hydrocarbons and boils in the range from 88° to 373° F.

The additive fuel of the invention was tested for its carburetor detergency in the Chevrolet Carburetor Detergency Test. This test is run on a Chevrolet V-8 engine mounted on a test stand using a modified four barrel carburetor. The two secondary barrels of the carburetor are sealed and the feed to each of the primary barrels arranged so that an additive fuel can be run in one barrel and the base fuel run in the other. The primary carburetor barrels were also modified so that they had removable aluminum inserts in the throttle plate area in order that deposits formed on the inserts in this area could be conveniently weighed.

In a procedure designed to determine the effectiveness of an additive fuel to remove performed deposits in the carburetor, the engine is run for a period of time usually 24 to 48 hours using the base fuel as the feed to both barrels with engine blow-by circulated to an inlet in the carburetor body. The weight of the deposits on both sleeves is determined and recorded. The engine is then cycled for 24 additional hours with a suitable reference fuel being fed to one barrel, additive fuel to the other and blowby to the inlet in the carburetor body. The inserts are then removed from the carburetor and weighed to determine the difference between the performance of the additive and reference fuels in removing the preformed deposits. After the aluminum inserts are cleaned, they are replaced in the carburetor and the process repeated with the fuels reversed in the carburetor to minimize differences in fuel distribution and barrel construction. The deposit weights in the two runs are averaged and the effectiveness of the fuel composition of the invention is compared to the reference fuel which contains an effective detergent additive. The difference in effectiveness is expressed in percent.

TABLE I

CHEVROLET CARBURETOR DETERGENCY TEST PHASE III[a]

| Run | Additive Fuel | Percent Washdown (Removal) of Preformed Deposits |
|---|---|---|
| 1. | Base Fuel (no Carb. deter. added) | −10[c] |
| 2. | Base Fuel + 10 PTB[b] Example I | +84 |
| 3. | Premium Fuel Composition C[d] | +65 |

[a]Clean-up type test
[b]PTB is Pounds per Thousand Barrels of Fuel
[c]– Denotes a deposit buildup
[d]Run 3 was made employing a premium commercial detergent fuel composition.

The foregoing data shows that the motor fuel composition of the invention, illustrated by Run 2, exhibits a surprising improvement over the base fuel, Run 1. The performance of the fuel composition of the invention also is superior to that of a premium commercial detergent fuel composition, Run 3.

The effect on carburetor detergency of the fuel composition of the invention was also determined in the Buick Carburetor Detergency Test. This test measures the ability of the detergent to prevent deposit build-up on an initially clean carburetor. The test uses a 1973 Buick 350 CID V8 engine equipped with a two-barrel carburetor. The engine was mounted on a dynamometer test stand and had operating and exhaust gas return, an air induction reactor and a positive crankcase ventilator. The test cycle, shown in Table I, is representative of normal road conditions. Approximately 300 gallons of fuel and 3 quarts of oil were required for each run.

Prior to each run, the carburetor was completely reconditioned. Upon completion of the run, the throttle plate deposits were rated visually according to a merit rating scale of 1 to 10 with "1" applied to extremely heavy deposits on the throttle and "10" to a completely clean plate. The test was conducted under various stages. Stage I, Stage II and III, representing different engine operating conditions insofar as engine speed, torque, duration, and the like. Thus, the test was conducted by initially running the engine at 650±25 r.p.m. for one hour followed by three hours at 1500±25 at 80±2 foot pounds torque followed by one hour at 2000±25 at 108±2 foot pounds torque. The cycles were repeated in such order for a total of 120 hours.

TABLE II

1973 BUICK CARBURETOR DETERGENCY TEST OPERATING CONDITIONS

| | Stage I | Stage II | Stage III |
|---|---|---|---|
| Duration-hours | 1 | 3 | 1 |
| Speed, r.p.m. | 650 ± 25 | 1500 ± 25 | 2000 ± 25 |
| Torque, foot pounds | 0 | 80 ± 2 | 108 ± 2 |
| Water out °F. | 205 ± 5 | 205 ± 5 | 205 ± 5 |
| Carburetor Air °F. | 140 ± 5 | 140 ± 5 | 140 ± 5 |
| Exhaust Back Pressure, in Hg. | — | 0.7 ± 0.1 | — |
| Man. Vac., in Hg. | — | 15.8 | 14.2 |
| Fuel flow, pounds per hour | 0.7 | 7.5 | 12.0 |
| Test duration, 120 hours | | | |

The results of this test are set forth in the following table:

TABLE III

BUICK CARBURETOR DETERGENCY TEST

| Run | Fuel Composition | Additive Concentration | Carburetor Rating (Average) |
|---|---|---|---|
| 1 | Base Fuel | None | 3.9 |
| 2 | Base Fuel | 5 PTB(1) of Example I | 7.6 |
| 3 | Base Fuel | 5 PTB Example II | 8.3(2) |
| 4 | Comparison Fuel C(3) | | 7.8 |
| 5 | Comparison Fuel D(3) | | 6.8 |

(1)PTB = pounds of additive per 1000 barrels of fuel
(2)Run in a 1981 Buick engine.
(3)Commercial unleaded detergent gasoline.

The foregoing results demonstrate that the novel fuel composition of the invention was surprisingly effective for achieving carburetor throttle plate cleanliness as measured by the CRC Varnish rating scale in the Buick Carburetor Detergency Test.

The rust inhibiting effect of the fuel composition of the present invention was determined in the National Association of Corrosion Engineers (NACE) Test.

In this test a mixture of 300 ml of test fuel and 20 ml distilled water is stirred at a temperature of 37.8° C. (100° F.) with a steel specimen completely immersed therein for a test period of 3½ hours. The percentage of the specimen that has rust is determined visually and noted.

The results of this test are set forth in the following table:

TABLE IV

NACE RUST TEST

| Additive in Unleaded Base Fuel | % Rust(1) |
|---|---|
| 5 PTB of Example I | Tr-1(3) 1-5; Tr-1 |
| 10 PTB of Example I | Tr-1; Tr-1; Tr-1 |
| 20 PTB of Example I | Tr-1; Tr-1, Tr-1 |

(1)less than 5% passes test.
(2)PTB = Pounds of additive per 1000 Barrels of fuel.
(3)Tr = Trace The foregoing results demonstrate that the novel fuel composition of the invention was surprisingly effective in preventing the formation of rust and the corrosion of the metal surfaces with which the fuel was in contact.

We claim:

1. As a detergent and corrosion inhibiting fuel additive the reaction product obtained by reacting an N-$C_{10}$ to $C_{25}$-hydrocarbyl-1,3-diaminopropane with trimellitic anhydride of the formula:

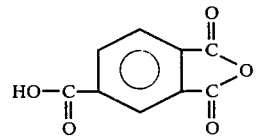

wherein the ratio of said diaminopropane to said trimellitic anhydride ranges from about 1.5:1 to about 2.5:1.

2. An additive according to claim 1, wherein said N-hydrocarbyl-1,3-diaminopropane is N-octadecenyl-1,3-diaminopropane.

3. An additive according to claim 1 wherein said N-hydrocarbyl-1,3-diaminopropane is N-dodecenyl-1,3-diamino-propane.

4. An additive according to claim 1 wherein said N-hydrocarbyl 1,3, diamino is N-lauryl-1,3,-diaminopropane.

5. A motor fuel composition comprising a mixture of hydrocarbons boiling in the gasoline boiling range and an effective amount of a detergent and corrosion inhibiting reaction product which is obtained by reacting a $C_{10}$ to $C_{25}$-hydrocarbyl diaminopropane with trimellitic anhydride of the formula:

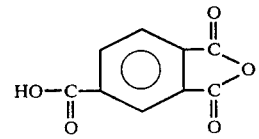

in which the ratio of said N-hydrocarbyl-1,3-diaminopropane to said trimellitic anhydride ranges from about 1.5:1 to about 2.5:1.

6. A motor fuel composition according to claim 5 wherein said hydrocarbyl diaminopropane is N-octadecenyl-1,3-diaminopropane.

7. A motor fuel composition according to claim 5 wherein said alkyl diaminopropane is N-dodecenyl-1,3-diaminopropane.

8. A motor fuel composition according to claim 5 containing from 0.0004 to 0.04 weight percent of said detergent and corrosion inhibiting reaction product.

9. A motor fuel composition according to claim 5 containing from 0.0004 to 0.008 weight percent of said detergent and corrosion inhibiting reaction product.

10. A motor fuel composition according to claim 5 containing from 0.002 to 0.004 weight percent of said detergent and corrosion inhibiting reaction product.

* * * * *